United States Patent [19]

Kitaoh

[11] Patent Number: 4,802,674

[45] Date of Patent: Feb. 7, 1989

[54] GOLF BALL

[75] Inventor: Katsutoshi Kitaoh, Takarazuka, Japan

[73] Assignee: Sumitomo Rubber Industries, Ltd., Hyogo, Japan

[21] Appl. No.: 26,888

[22] Filed: Mar. 17, 1987

[30] Foreign Application Priority Data

Mar. 17, 1986 [JP] Japan ..... 61-39155

[51] Int. Cl.[4] ..... A63B 37/12

[52] U.S. Cl. ..... 273/235 A; 273/DIG. 022

[58] Field of Search ..... 273/235 R, 235 A, 235 B, 273/233, 234; 40/327

[56] References Cited

U.S. PATENT DOCUMENTS 2,015,165 9/1935 Twiss et al. ..... 273/235 A 4,679,794 7/1987 Yamada et al. ..... 273/235 R

*Primary Examiner*—George J. Marlo

*Attorney, Agent, or Firm*—Birch, Stewart, Kolasch & Birch

[57] ABSTRACT

A golf ball prepared by covering a golf ball core with an ionomer resin composition comprising 0.5 to 10% by weight of a white pigment and 0.2 to 0.6% by weight of a fluorescent whitening agent, wehrein the % of the pigment and the agent are based on the total weight of the resin composition. The ionomer resin cover is coated with an enamel paint comprising 1 to 10% by weight of a pigment, wherein the % is based on the solid content of said enamel paint. A clear paint may be applied either on the enamel layer or between the enamel layer and the ionomer resin cover.

13 Claims, 1 Drawing Sheet

GOLF BALL

FIELD OF THE INVENTION

The present invention relates to a golf ball which is coated by paints.

BACKGROUND OF THE INVENTION

There are enameled golf balls and non-enameled golf balls commercially available. The enamaled golf balls are produced by coating its surface once or twice with an enamel paint which contains a pigment which comprises from about 20 to 50% by weight based on the solid content of the paint. The color of the enameled golf balls appear as the color of the enamel paint, because the color of the golf ball is concealed by the enamel paint. The non-enameled golf balls are produced by coating only with a clear paint. The color of the non-enameled golf balls is the same as the color of the golf ball itself.

In order to impart a beautiful color to a golf ball, pigments are formulated into a cover composition. This attempt, however, would be unsuccessful if an enamel paint having opacifying properties which are too high is applied to a golf ball in the same manner as applied to the enameled golf balls. In case of the non-enameled golf balls, it is required to formulate the pigments into a cover composition of the golf balls in a large amount in order to obtain the same color tone as the enameled golf balls. However, this causes the physical properties of the golf ball to deteriorate. Also, since the non-enameled golf balls have no enamel layers, ultraviolet lights are transmitted through the clear coat layer without any barriers so as to lead to a deterioration of surface properties, especially in the adhesion properties. Especially, in the case of a golf ball which is covered with an ionomer resin, the ionomer resin becomes severely deteriorated by ultraviolet lights which gives rise to a ply separation between the clear paint layer and the ionomer resin cover. For preventing the deterioration of adhesion properties, it is proposed to formulate an ultraviolet absorber into a clear paint. However, the formulation of the ultraviolet absorber would decrease the fine view and gloss of the cover. Further, if there are stains on the surface of the golf ball, these stains would be in plain sight and would diminish the commodity quality thereof.

It is desirable to develop golf balls having the desirable properties of both the enameled and non-enameled golf balls, as well as having the good appearance of both.

SUMMARY OF THE INVENTION

An object of the present invention is to provide a golf ball having the desirable properties of both the enameled and non-enameled golf balls. The golf ball is produced by coating its surface with an enamel paint containing a pigment of 1 to 10% by weight based on the solid content of the paint. An enamel paint conventionally used for golf balls contains about 20% by weight of pigments, but the enamel paint employed by the present invention contains 1 to 10% by weight which is less than the conventional one.

Another object of the present invention is to provide a two-piece golf ball prepared by coating a golf ball core with a resin composition comprising a pigment of 0.5 to 10% by weight and a cover resin of 0.5 to 10% based on said resin composition, and then coating the coated golf ball core with an enamel paint containing a pigment of 1 to 10% by weight based on a the solid content of said paint.

DETAILED DESCRIPTION OF THE INVENTION

Figure 1:
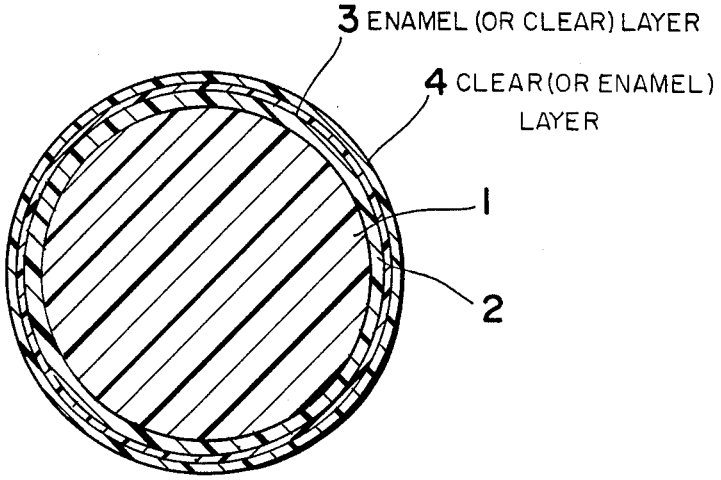
FIG. 1 is a sectional view of a two-piece golf ball of the present embodiment.

The enamel paint employed in the present invention includes an epoxy enamel paint, an aqueous urethane enamel paint or a solvent type urethane enamel paint. The enamel paint contains a pigment in an amount of 1 to 10% by weight, preferably 5 to 10% by weight based on the solid content of the enamel paint. When the amounts of the pigment are less than 1% by weight, the surface of the golf ball would be exposed to a high amount of the ultraviolet light as mentioned in the case of the non-enameled golf balls. When the amounts of the pigment are more than 10% by weight, the opacifying properties are too high to decrease the transparency and depth in the appearance of the golf ball.

The pigment formulated in the enamel paint includes a pigment having high opacifying properties, such as titanium dioxide, zinc oxide and the like; a pigment having transparency, such as micronized barium sulfate, zinc sulfate and the like. The pigment having transparency imparts high transparency to the obtained golf ball with preserving weather resistance. Preferred are the pigments having high opacifying properties.

The thickness of the enamel coating layer is generally within the range of 5 to 30 micron, preferably 10 to 25 micron. For obtaining a suitable thickness of the coating layer, a coating process can be repeated. A thickness of more than 30 micron makes meaningless the use of an enamel paint containing less amounts of the pigment than the amounts used in conventional enamel paints. Thus the color of the enameled golf ball does not reflect the basic color of a golf ball. The thickness of less than 5 microns does not impart the technical effects by the enamel coatings of the present invention.

A golf ball to be utilized in the present invention includes a one-piece golf ball, a balata covered golf ball or an ionomer covered golf ball. Preferred is the ionomer covered golf ball.

According to the present invention, it is preferred that the color of the golf ball be the same as the enamel paint to be coated. For imparting an excellent appearance to the golf ball, in the case of a white two-piece golf ball, it is preferred that the golf ball is prepared by covering a core with a resin composition containing a white pigment of 0.5 to 10% by weight and a cover resin of 0.5 to 10% by weight based on the composition. It is more preferred that the resin composition for the golf ball additionally contains a fluorescent whitening agent in an amount of 0.2 to 0.6% by weight.

The present invention is further explained with reference to FIG. 1.

The enamel paint mentioned above is coated once or twice by a conventional method on a golf ball which is prepared by covering core 1 with cover 2 to form enamel layer 3, to which a clear paint is applied to form outermost clear layer 4. If desirable, a clear paint layer may be formed between the golf ball and enamel layer 3. The clear paint includes a urethane type clear paint, an acryl type clear paint, an epoxy type clear paint and the like.

The present invention is illustrated by the following examples, which, however, are not to be construed as limiting the present invention to the details thereof.

Examples 1 to 9 and Comparative Examples 1 to 6

Paints are applied to two piece golf balls which are covered by an ionomer resin composition (an ionomer resin (Surlyn 1605/1706=50/50 blend)/$TiO_2$=98/2 by weight) as shown in Table 1. Evaluation was made on appearance, paint adhesion after a weather resistance test, yellowing after a weather resistance test, crack resistance of the paint, opacifying properties of stains of the cover. The result of the evaluation is shown in Table 1.

TABLE 1

| | | | Example | | | | | | | | |
|---|---|---|---|---|---|---|---|---|---|---|---|
| | | | 1 | 2 | 3 | 4 | 5 | 6 | 7 | 8 | 9 |
| Pigment content* (%) | First layer | Epoxy paint | 5 | 5 | 10 | 0 | — | — | — | — | 8.0 |
| | | Aqueous urethane paint | — | — | — | — | 5 | 5 | 10 | 0 | — |
| | Second layer | Urethane paint | 0 | 5 | 0 | 5 | 0 | 5 | 0 | 5 | 10.0 |
| | Third layer | Urethane paint | 0 | 0 | 0 | 0 | 0 | 0 | 0 | 0 | 0 |
| Evaluation | Appearance (Contribution of the color of the cover) | | Exist | Exist | Exist | Exist | Exist | Exist | Exist | Exist | Exist |
| | Paint adhesion after a weather resistance test[1] | | Fairly good | Good | Good | Fairly good | Good | Good | Good | Good | Good |
| | Yellowing after a weather resistance test[2] | | Good | Good | Good | Good | Good | Good | Good | Good | Good |
| | Opacifying properties of the stains on the cover | | Fairly good | Good | Good | Fairly good | Good | Good | Good | Fairly good | Good |
| | Crack resistance of the paint[3] | | Good | Good | Good | Good | Good | Good | Good | Good | Good |
| | Total judgement | | O | O | O | O | O | O | O | O | O |

| | | | | Comparative Example | | | | | |
|---|---|---|---|---|---|---|---|---|---|
| | | | | 1 | 2 | 3 | 4 | 5 | 6 |
| Pigment content* (%) | First layer | Epoxy paint | | 0 | 20 | 20 | 20 | — | — |
| | | Aqueous urethane paint | | — | — | — | — | 0 | 0 |
| | Second layer | Urethane paint | | 0 | 0 | 5 | 20 | 0 | 20 |
| | Third layer | Urethane paint | | 0 | 0 | 0 | 0 | 0 | 0 |
| Evaluation | Appearance (Contribution of the color of the cover) | | | No | No | No | No | Exist | No |
| | Paint adhesion after a weather resistance test[1] | | | Bad | Good | Good | Good | Bad | Good |
| | Yellowing after a weather resistance test[2] | | | Good | Good | Good | Good | Good | Good |
| | Opacifying properties of the stains on the cover | | | Bad | Good | Good | Good | Bad | Good |
| | Crack resistance of the paint[3] | | | Good | Fairly good | Fairly good | Fairly good | Good | Fairly good |
| | Total judgement | | | X | X | X | X | X | X |

[1]After a golf ball was treated in Sunshine Weather-O-Meter for 60 hours and immersed in water for 24 hours, it was collided with a steel board 100 times at a speed of 45 m/sec. After this test, a condition of paint adhesion is observed.

[2]After a golf ball was treated in Sunshine Weather-O-Meter for 120 hours, color difference, i.e. ΔL, Δa, Δb, ΔE values, was measured by a color difference meter, yellowing was evaluated by eyes and color difference.

[3]A crack condition of the paint layer is observed after colliding a golf ball with a steel board 100 times at a speed of 45 m/sec.

*The pigment was titanium dioxide. Percentage is based on the solid content of a paint.

Examples 10, 11 and Comparative Example 7

Paints are applied to two-piece golf balls which are coated with an ionomer resin composition (an ionomer resin (Surlyn 1605 made dual ioning by Mg ions [see USP 4,526,375])/$TiO_2$/a fluorescent whitening agent Whiteflour HCS=97.9/1.8/0.3 by weight) as shown Table 2. Evaluation is made on appearance, paint adhesion after a weather resistance test, yellowing after a weather resistance test, crack resistance of the paint, opacifying properties of stains of the cover. The result of the evaluation is shown in Table 2.

TABLE 2

| | | Example | | Comparative Example |
|---|---|---|---|---|
| | | 10 | 11* | 7 |
| Fluorescent whitening agent content (%) | | 0.3 | 0.3 | 0.3 |
| Pigment content (%) | First layer Epoxy paint | 5 | 5 | 0 |
| | Second layer Urethane paint | 5 | 5 | 0 |
| | Third layer Urethane paint | 0 | 0 | 0 |
| Evaluation | Appearance (Contribution of the color of the cover) | Exist | Exist | Exist |
| | Paint adhesion after a weather resistance test | Good | Good | Bad |
| | Yellowing after a weather resistance test | Good | Good | Bad |
| | Opacifying properties of the stains on the cover | Good | Fairly good | Bad |
| | Crack resistance of the paint | Good | Good | Good |
| | Total judgement | O | O | X |

*This example employs a micronized precipitated barium sulfate, and the other examples employ titanium dioxide.

What is claimed is:

1. A golf ball prepared by coating a golf ball core with an ionomer resin composition comprising 0.5 to 10% by weight of a pigment and 0.2 to 0.6% by weight of a fluorescent whitening agent, wherein the % of the pigment and the agent are based on the total weight of the resin composition and then coating the ionomer resin composition coated golf ball core with an enamel paint comprising 1 to 10% by weight of a pigment, wherein the % is based on the solid content of said enamel paint.

2. The golf ball according to claim 1 wherein the golf ball is a two-piece golf ball.

3. The two-piece golf ball according to claim 2 wherein the pigment is $TiO_2$.

4. The golf ball according to claim 1 wherein the thickness of the enamel coating is within the range of 10 to 25 microns.

5. The golf ball according to claim 1 wherein the color of the golf ball is the same as the color of the enamel paint.

6. The golf ball according to claim 1, wherein the coating with the ionomer resin composition and enamel paint is followed by coating with a clear paint.

7. The golf ball according to claim 6, wherein the clear paint is a urethane clear paint, an acryl clear paint or an epoxy clear paint.

8. The golf ball according to claim 1 wherein the enamel paint is an epoxy enamel paint, an aqueous urethane enamel paint or a solvent type urethane enamel paint.

9. The golf ball according to claim 1 wherein the pigment is titanium dioxide, zinc oxide, micronized barium sulfate, zinc sulfate, a mixture thereof.

10. The golf ball according to claim 1 wherein the thickness of the enamel coating is within the range of 5 to 30 micron.

11. The golf ball according to claim 1 wherein said core is a one-piece construction.

12. A golf ball prepared by coating a golf ball core with an ionomer resin composition comprising 0.5 to 10% by weight of a pigment and 0.2 to 0.6% by weight of a fluorescent whitening agent, wherein the % of the pigment and the agent are based on the total weight of the resin composition, coating the ionomer resin composition coated golf ball with a clear paint which in turn is coated with an enamel paint comprising 1 to 10% by weight of a pigment, wherein the % is based on the solid content of said enamel paint.

13. The golf ball according to claim 12, wherein the clear paint is a urethane clear paint, an acryl clear paint or an epoxy clear paint.

* * * * *